United States Patent [19]

Shaw et al.

[11] Patent Number: 4,987,931

[45] Date of Patent: Jan. 29, 1991

[54] WEFT SUPPLY DEVICE INCLUDING MULTIPLE THREAD PACKAGES AND PREPARATION MECHANISMS

[75] Inventors: Henry Shaw, Vleteren; Roger Ligneel, Beselare, both of Belgium

[73] Assignee: Picanol N.V., Belgium

[21] Appl. No.: 384,807

[22] Filed: Jul. 25, 1989

[30] Foreign Application Priority Data

Jul. 25, 1988 [BE] Belgium ..... 8800860
Jul. 25, 1988 [BE] Belgium ..... 8800863
Jul. 25, 1988 [BE] Belgium ..... 8800864

[51] Int. Cl.[5] ..... D03D 47/34

[52] U.S. Cl. ..... 139/450; 139/452; 242/131

[58] Field of Search ..... 139/453, 450, 452, 11, 139/457, 458, 459, 14–16; 242/131; 66/132 R, 132 T

[56] References Cited

U.S. PATENT DOCUMENTS 3,526,253 9/1970 Pfarrwaller .
3,575,018 4/1971 Levin ..... 66/132 T
4,066,104 1/1978 Halton et al. ..... 139/17 X
4,149,678 4/1979 Miyazaki et al. .
4,573,856 3/1986 Meyer et al. .

FOREIGN PATENT DOCUMENTS 404413 8/1934 Belgium .
1000768 3/1984 Belgium .
2017171 10/1979 United Kingdom ..... 139/450

*Primary Examiner*—Andrew M. Falik
*Attorney, Agent, or Firm*—Bacon & Thomas

[57] ABSTRACT

A device for supplying weft threads in weaving machines with minimal twisting includes at least one rotatable set of thread supplies and one rotatable set of thread preparation mechanisms per set of thread supplies. The sets of thread preparation mechanisms are rotatable together with corresponding sets of thread supplies forming a rotatable assembly to prevent the weft threads from becoming tangled with one another as the sets rotate, for example to bring one of the thread preparation mechanisms adjacent a repair mechanism, or to change threads. A mechanism is further included which converts the rotational motion of the rotatable assembly into a translational motion essentially in the direction of the axis around which the assembly turns. By a suitable choice of the mechanism, lengthening of the thread after rotation can be fully compensated for by the translational motion of the thread supplies and of the corresponding thread preparation mechanisms.

35 Claims, 10 Drawing Sheets

Fig.3
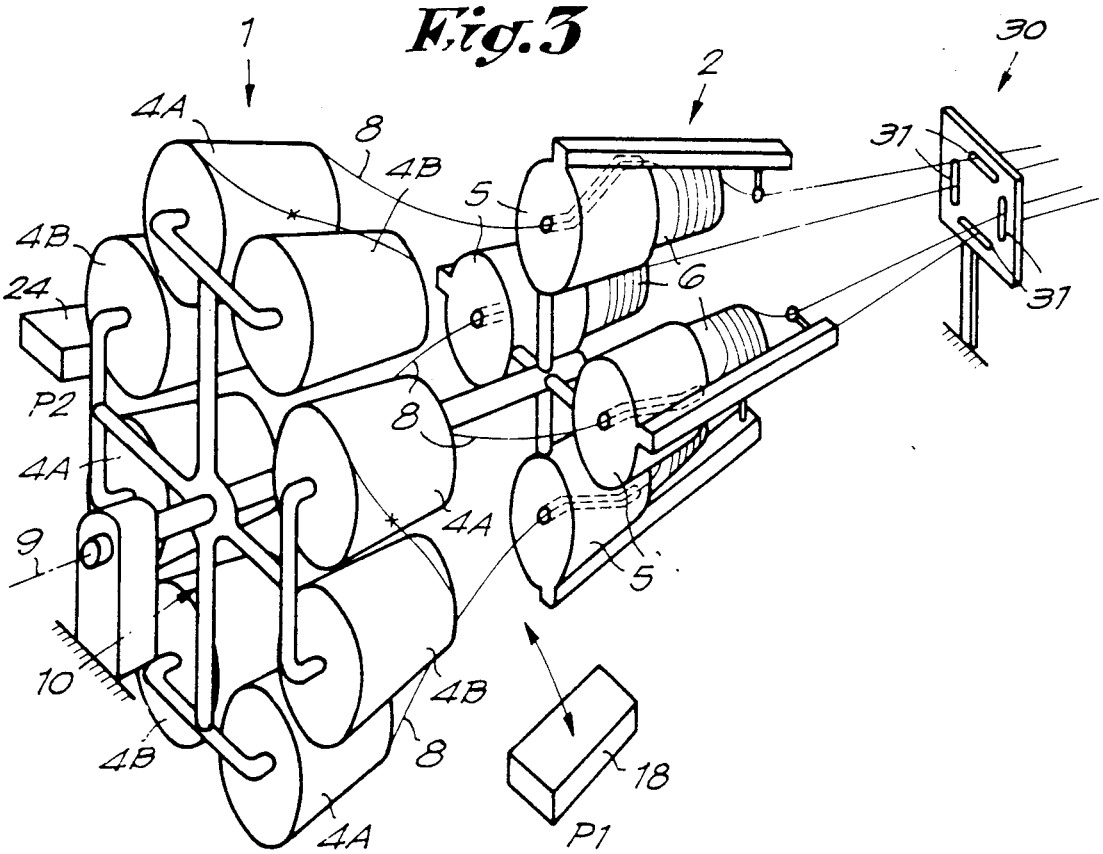
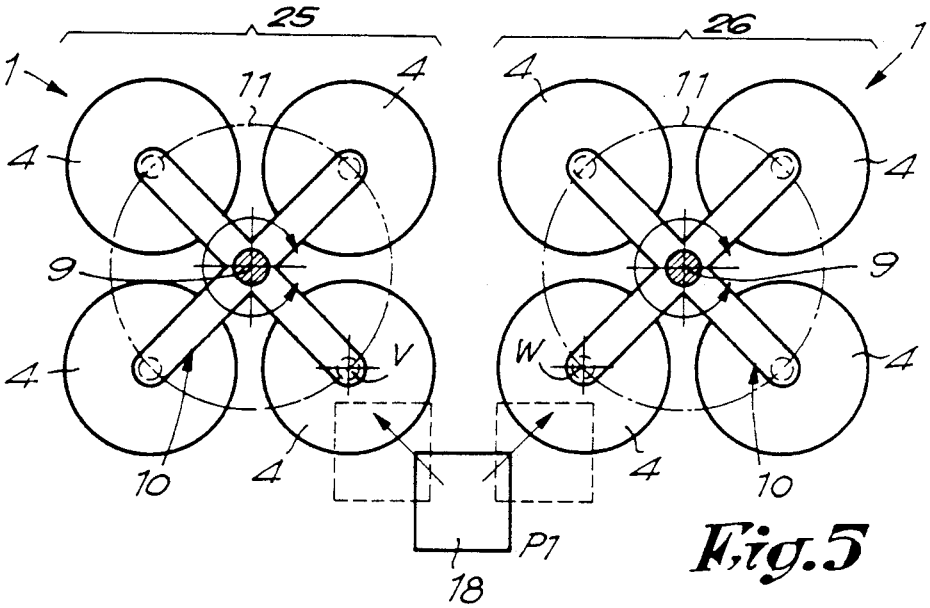
Fig.5

Fig. 7
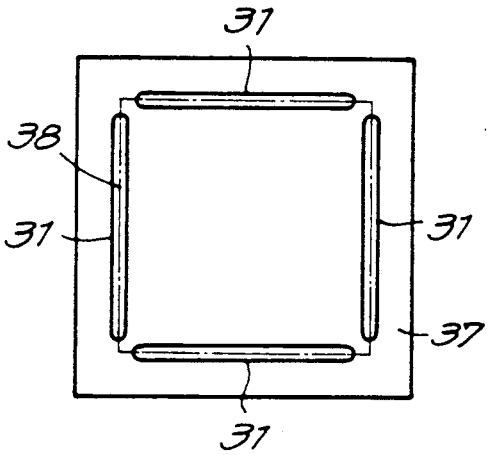
Fig. 12
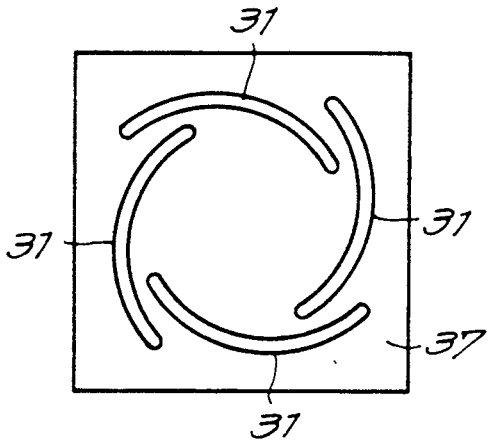
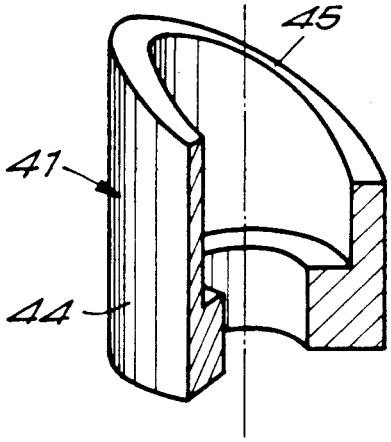
Fig. 17

WEFT SUPPLY DEVICE INCLUDING MULTIPLE THREAD PACKAGES AND PREPARATION MECHANISMS

BACKGROUND OF THE INVENTION

This invention concerns a device for supplying weft threads on weaving machines, in particular shuttleless weaving machines, such as for example rapier weaving machines or airjet weaving machines.

As is known, devices for supplying weft threads generally include thread supplies formed by yarn packages or bobbins; thread preparation mechanisms such as prewinders for unwinding a certain quantity of weft thread from the supply packages and holding it in readiness on a drum; and insertion means in order to take particular lengths of weft thread one by one from the respective thread preparation mechanisms and insert them into the shed.

The yarn packages are usually mounted on a package frame. In order to be able to reach the yarn packages easily, it is known for the package frame to be rotatable. From U.S. Pat. No. 3,526,253 it is known for the weft threads to be led to the axis of rotation of the package frame and to the respective thread preparation mechanisms via a number of thread guides and bending points. Such package frames have the disadvantage that the weft threads have to follow a relatively long path before they reach the thread preparation mechanisms, passing through various guides, so that the chance of thread breaks is greatly increased. Another important disadvantage is that whenever such a package frame is turned, in order to replace a yarn package or to carry out a repair, the different weft threads get tangled in one another even at a small angle of rotation.

SUMMARY OF THE INVENTION

The present invention has as its aim a device for supplying weft threads which does not have the above-mentioned disadvantages. To this end the weft threads are led via a minimum number of bending points.

According to the invention, the package frame can be rotated through such a large angle that all the yarn packages mounted on it can be presented at the same point, for example the point where a repair unit is positioned, without the weft threads getting tangled in one another.

For this purpose the invention concerns a device for supplying weft threads on weaving machines, including at least one rotatable set of thread supplies; one set of thread preparation mechanisms per set of thread supplies, where the set of thread preparation mechanisms can rotate together with the set of thread supplies, and where said thread preparation mechanisms operate with the respective thread supplies; and insertion means for inserting weft threads into a shed of the weaving machine. The fact that both the thread preparation mechanisms and the thread supplies are rotatably mounted makes possible a particularly compact construction. Rotating the thread supplies and the thread preparation mechanisms can be done manually or automatically, according to different variants.

Rotating the assembly formed by the thread supplies and the corresponding thread preparation mechanisms normally results in the length of the path followed by the weft threads to the first fixed mounted thread guide elements being increased, so that when said rotatable assembly is returned to its original position the weft threads sag, which in certain circumstances can have unfavourable consequences, such as the weft threads becoming entangled. In order to avoid this disadvantage, the device according to the invention has in a particular embodiment a special thread guide which limits the sagging of the weft threads as a result of lengthening when said rotatable assembly is rotated. This particular thread guide also ensures that the weft threads between the thread preparation mechanisms and the insertion means do not come in contact with each other anywhere when said rotatable assembly is rotated, even if it is rotated through a relatively large angle. To this end, said thread guide includes: first thread guide devices formed by thread guide points arranged in a ring and which rotate with said rotatable assembly, the weft threads leaving said assembly via the first thread guide devices; second fixedly-mounted; thread guide devices via which the weft threads are led to the insertion means; and third fixedly-mounted thread guide devices mounted between the above-mentioned first and second thread guide devices, consisting essentially of a number of thread guide slots arranged in a ring and which operate with the respective weft threads.

According to another particular embodiment, the device according to the invention has a means which converts the rotational motion of the above-mentioned rotatable assembly into a translational motion essentially in the direction of the axis around which said assembly turns. By a suitable choice of said device, the lengthening of the threads described above can be fully compensated for by the translational motion of the thread supplies and of the corresponding thread preparation mechanisms.

BRIEF DESCRIPTION OF THE DRAWINGS

In order to describe the characteristics of the invention, the following embodiments are described, by way of example only and without being limitative in any way, with reference to the drawings, where:

FIG. 3 is a perspective view of variant of the device according to the invention;

FIG. 5 is an end view in the direction of arrow F5 in FIG. 4;

FIG. 7 is a front elevation of the part indicated in FIGS. 1 and 6 by F7, to a greater scale;

FIG. 12 is a front elevation of a variant of the part indicated in FIG. 7;

FIG. 17 is a perspective view of the part indicated in FIGS. 15 and 16 by arrow F17, to a greater scale;

DESCRIPTION OF THE PREFERRED EMBODIMENTS

Figure 1:
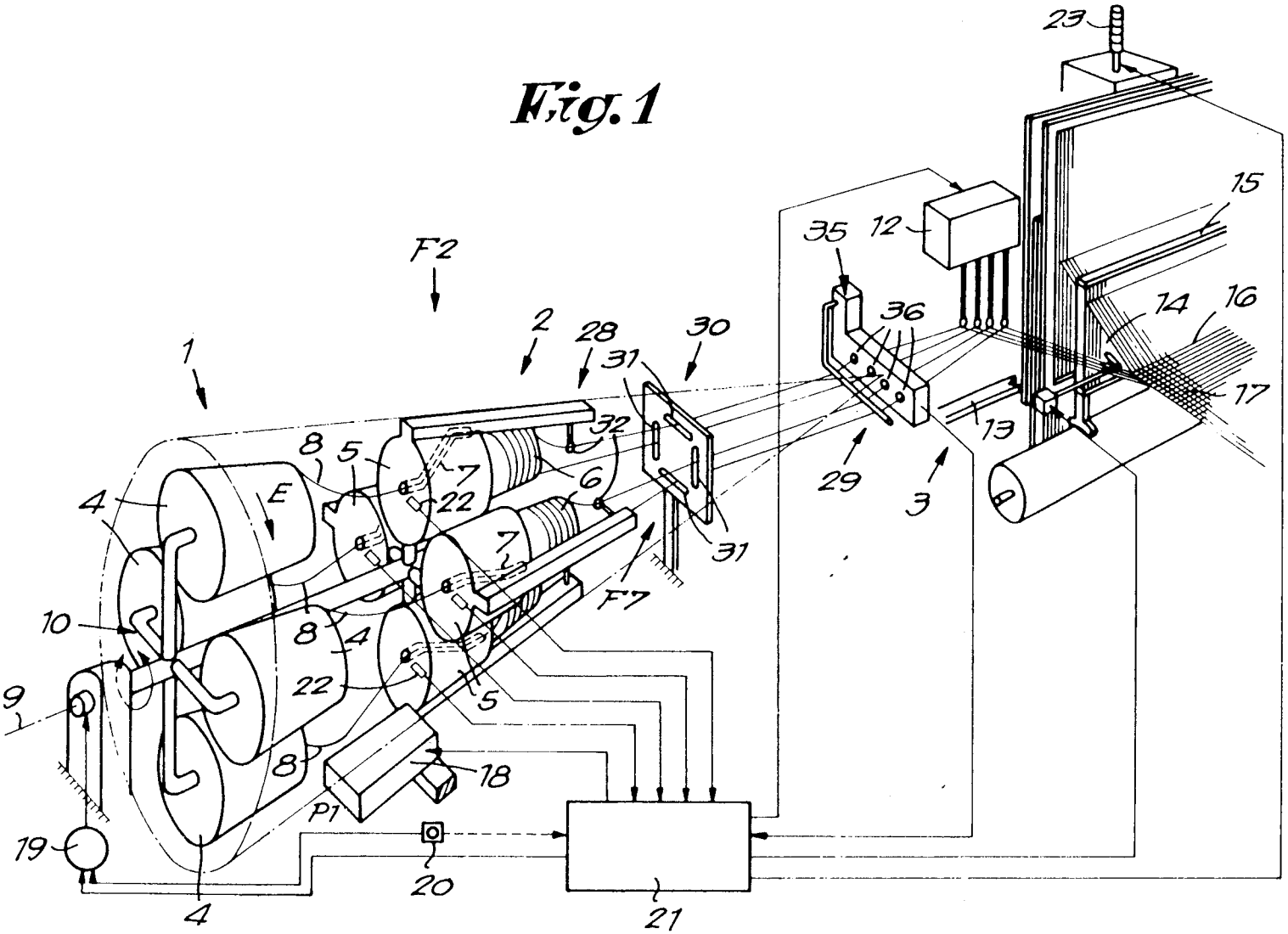
FIG. 1 is perspective view, including a schematic depiction of a control unit of the device according to the invention.

As shown in FIG. 1 the device according to the invention includes at least one rotatable set of thread supplies 1, at least one set of thread preparation mechanisms 2 which can rotate with said set of thread supplies 1, and insertion means 3.

The thread supplies consist of yarn packages 4. The thread preparation mechanisms 5 of said set 2 are formed by conventional prewinders which consist in the known way of fixed prewinder drums 6 and rotating winding tubes 7, by means of which the weft threads 8 can be drawn from the yarn packages 4 and wound on the prewinder drums 6.

Each of the thread supplies operates in conjunction with one thread preparation mechanism.

The set of thread supplies 1 and the set of thread preparation mechanisms 2 can preferably rotate about a common horizontal axis of rotation 9, and for this purpose are mounted on the same rotating frame 10. Each thread supply, that is each yarn package 4, is mounted in line with its corresponding thread preparation mechanism 5. The yarn packages 4 and the thread preparation mechanisms 5 are mounted at different points around the axis of rotation 9 and are positioned concentrically around it, such that they extend along the surface of a cone whose apex is towards the insertion means 3.

Figure 2:
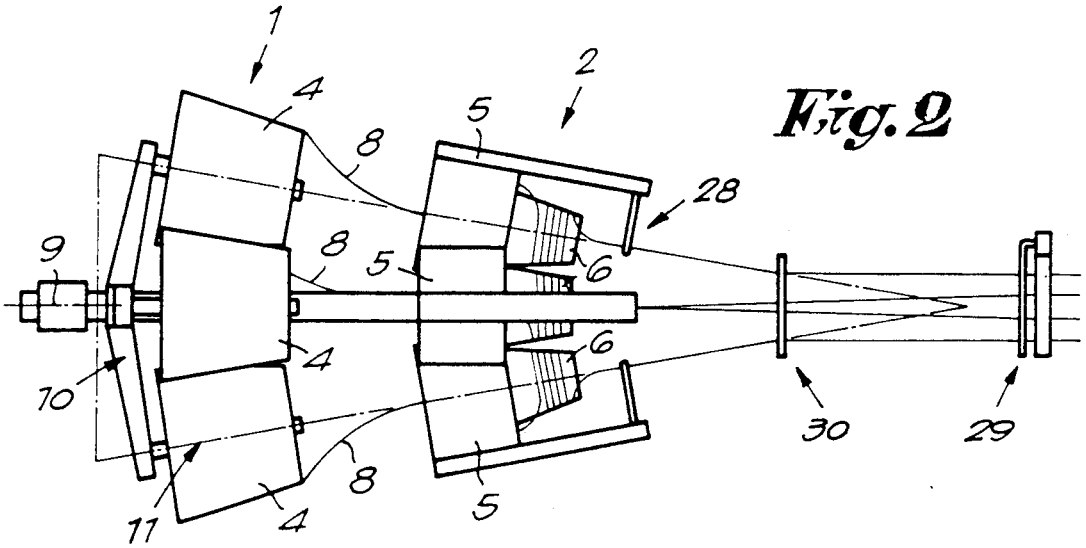
FIG. 2 is a side view in the direction of arrow F2 in FIG. 1.

In the case where there is only one yarn package 4 per thread preparation mechanism 5, the different components are preferably arranged relative to each other such that the respective axes through each yarn package 4 and the corresponding thread preparation device 5 are the generatrixes of the surface of a cone 11, as shown in FIG. 2.

The above-mentioned insertion means 3 can, as is known, be of various types, depending on the kind of weaving machine. FIG. 1 illustrates the case of a rapier weaving machine, where the insertion means 3 consists essentially of a thread presentation mechanism 12 and the rapiers 13 by means of which the weft thread 8 after it has been presented can be brought into the shed 14, whereupon said weft thread 8 is beaten up against the fell line 16 of the cloth 17 by the reed 15 in the known way.

Clearly, in the case of an airjet weaving machine, the insertion means 3 would be the auxiliary main nozzles and the main nozzles.

The device according to the invention offers the advantage that when the set of thread supplies 1 rotates, the set of thread preparation mechanisms 2 rotates with it, so that no tangling of the weft threads between the yarn packages 4 and the thread preparation mechanisms 5 can occur. This simultaneous rotation also enables the yarn packages 4 and the thread preparation mechanisms 5 to be brought to the same point P1 by a suitable angular displacement of the frame 10. This offers the advantage that as shown in FIG. 1, peripheral equipment can be positioned at this point, for example a repair unit 18 or the like, in order to repair a broken weft thread 8 and/or to rethread the corresponding thread preparation mechanism.

Clearly, the rotation of the set of thread supplies 1 and the set of thread preparation mechanisms 2 can be done manually or by means of a drive mechanism, such as a motor 19. The motor 19 can for example be activated by means of a push-button control 20 or the like and/or by means of an automatic control unit 21. In the latter case, said control unit 21 can be coupled to a number of detection devices, such as detectors 22 positioned at the entrances of the thread preparation mechanisms 5, in order to detect faults, including breaks, in the course of the weft thread 8. If a thread break is detected, a suitable signal is supplied to the control unit 21, with the result that, for example, the thread presentation mechanism 12 is commanded not to insert the broken weft thread any further and the motor 19 is activated until the yarn package 4 and the thread preparation mechanism 5 in which the fault has occurred has been brought automatically in front of the repair unit 18. An automatic repair can then be carried out, after which the device can be returned to its original position.

While the yarn packages 4 and the thread preparation mechanisms 5 are being displaced automatically and the broken weft thread 8 is being repaired, a signalling device 23 can be operated by the control unit 21.

As shown in FIG. 3, each of the above-mentioned thread supplies can of course also consist of two yarn packages 4A and 4B, where the trailing end of the weft thread 8 of the yarn package 4A in use is connected to the leading end of the weft thread of the second yarn package 4B. As soon as one yarn package 4A runs out, there is automatic switch-over over to yarn package 4B. The present invention enables the device to be rotated without any danger of entanglement of the threads of the set of thread supplies 1, and thus also of the set of thread preparation mechanisms 2. As a result, the point where the empty package is located can be moved to a fixed point P2, where for example there can be an apparatus 24 which automatically replaces the empty reel with a full package, which is then tied to the above-mentioned yarn package 4B, such that a continuous supply of weft thread 8 is ensured. Such package replacement apparatuses are disclosed, for example, in U.S. Pat. No. 4,573,856 and Belgian patent publication No. 1.000.768. The weaving process does not have to be interrupted while this is going on.

Figure 4:
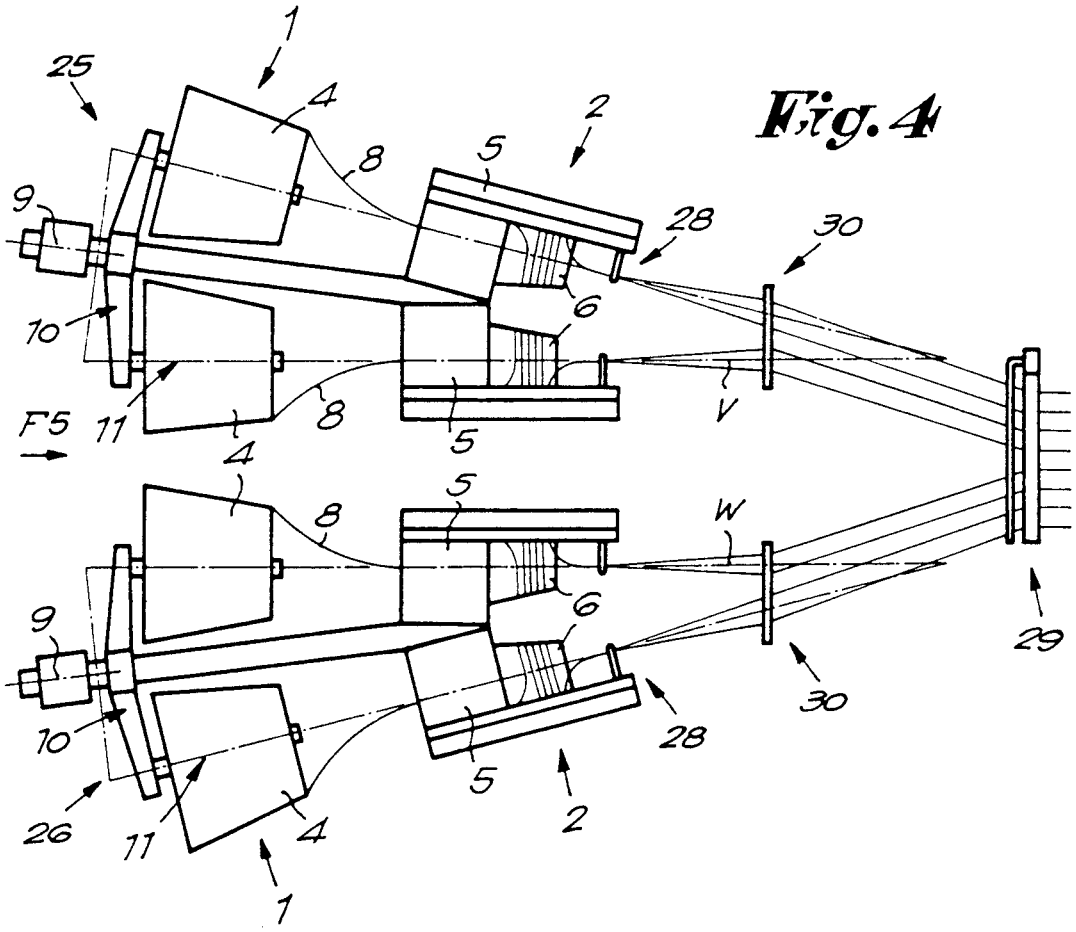
FIG. 4 is a side view of a another variant of the invention.

FIGS. 4 and 5 show a variant in which the device consists of a double version of the assembly shown in FIG. 1, where the respective sets of thread supplies 1 and sets of thread preparation mechanisms 2 are mounted next to each other. The above-mentioned cone shape 11 here occurs twice. The cones 11 are preferably positioned relative to each other so that the generatrixes V and W closest to the repair unit 18, which is located between the cones 11, are parallel to each other. This enables said repair unit 18 to be used for either of the one part 25 or the other part 26 of the device, without any further provision.

Clearly, the repair unit 18 shown in FIG. 5 can also be replaced by another apparatus, for example an apparatus for changing empty yarn packages 4.

In order to be able to continue weaving without interruption using the unbroken weft threads 8 while a repair or the like is being carried out as mentioned above, the device according to the invention preferably also has a guide which permits the assembly 27 formed by the set of thread supplies 1 and the set of thread preparation mechanisms 2 to be rotated through an angle of at least 180 degrees without the weft threads 8 between said assembly 27 and the insertion means 3 becoming entangled.

Figure 6:
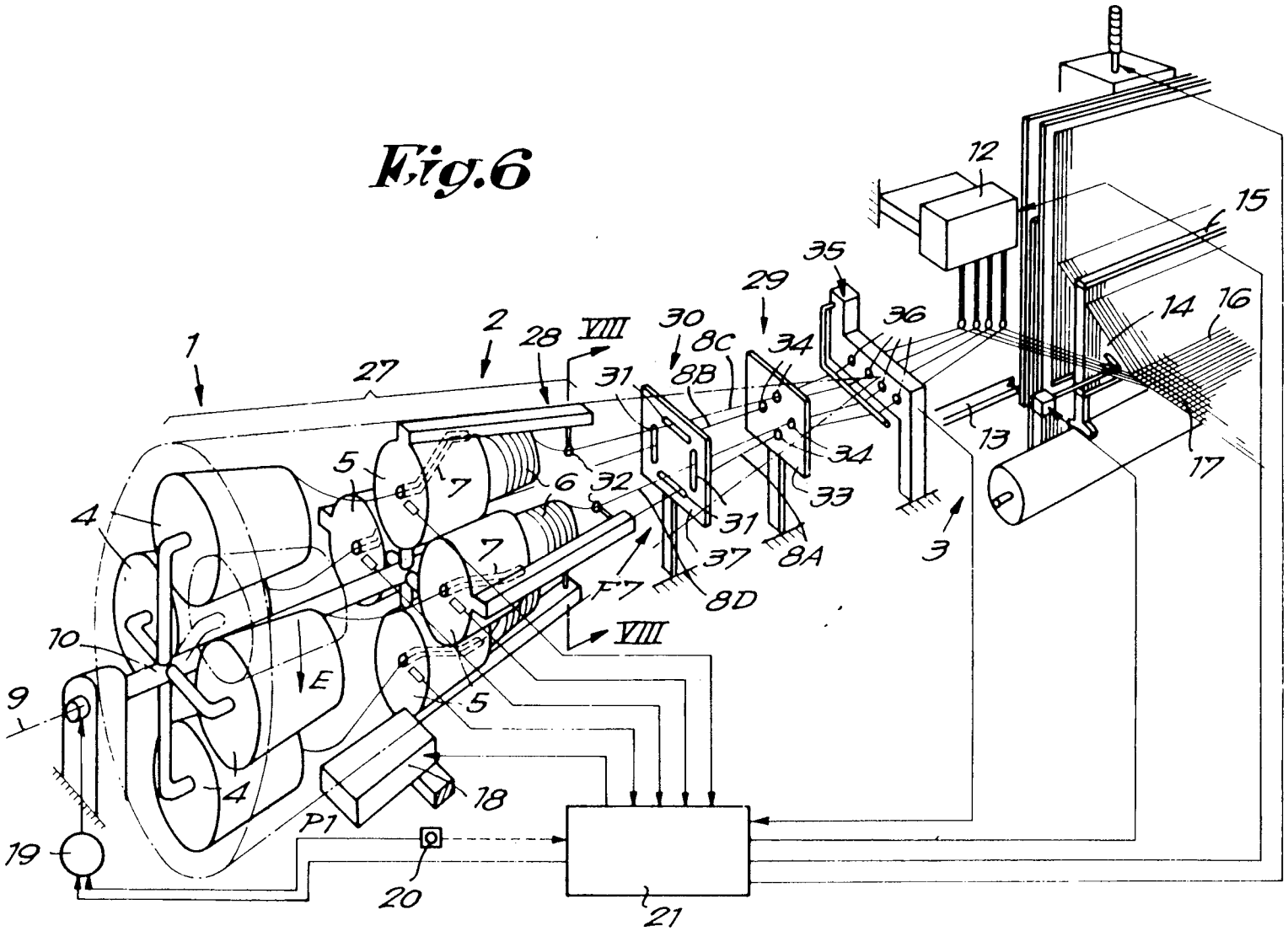
FIG. 6 is a view similar to that of FIG. 1 of a particular embodiment of the invention.

As shown in FIG. 6, said thread guide mechanism includes: a first thread guide device 28 formed by thread guide points arranged in a ring, which rotate together with the above-mentioned rotatable assembly 27, and via which the weft threads 8A to 8D leaving said assembly 27 via the thread guide points; a second, fixedly-mounted thread guide device 29 by way of which the weft threads 8A to 8D are led to the insertion means 3; and a third, fixedly-mounted thread guide device 30 positioned between the first and second thread guide devices 28 and 29, with the special characteristic that the thread guide devices include a number of thread guide slots 31 arranged in a ring, which operate in conjunction with the respective weft threads 8A to 8D.

In the embodiment shown in FIG. 6 the thread guide points arranged in a ring of the first thread guide device 28 are formed by the thread eyes 32 of the outputs of the thread preparation mechanisms 5, where said thread eyes 32 describe a common rotational motion as a result of the rotation of the assembly 27.

The above-mentioned second thread guide device 29 preferably includes an element, for example in the form of a plate 33, in which are thread eyes 34 which form fixed thread guide points. The weft threads 8A to 8D are led from the second thread guide device 29 to the insertion means 3, possibly as shown in FIG. 6 via a fixed-mounted weft detector 35 which itself is common technology and which, as is known, on rapier weaving machines consists of a series of motion detectors in the form of thread eyes 36 mounted next to each other, which monitor the presence and the motion of their respective weft threads 8A to 8D, and which for this purpose are connected to the control unit 21.

The special feature of the thread guide is the third thread guide device 30, which as already mentioned has thread guide slots 31 which are essentially arranged in a ring and which as a result of their specific shape offer the advantage that when the assembly 27 rotates the risk of the weft threads 8A to 8D becoming entangled is reduced to a minimum, and that during the rotation the lengthening of the threads 8A to 8D between the first and second thread guide devices, i.e. in the case illustrated in FIG. 6 between thread eyes 32 and 34, is also kept to a minimum. The thread guide slots 31 preferably consist of openings in a fixed mounted plate 37. As shown to a greater scale in FIG. 7, in the simplest embodiment use is made of straight thread guide slots 31 arranged in a ring as to form the edges of a square 38.

The thread guide slots 31 offer the advantage that the assembly 27 can be rotated while the weaving machine is operating, for example in order to rethread a thread preparation mechanism 5 or to replace an empty yarn package 4 with a full one, without any danger of interrupting the weft thread supply.

The operation of the thread guide is illustrated in FIGS. 8 to 11, which show different positions of the assembly 27, as cross-sections along the line VIII—VIII in FIG. 6. They show in particular how the yarn packages 4 and the thread preparation mechanisms 5 can all be simply presented at the same point P1 where they either can be reached easily by the weaver or can be presented to a repair unit 18 or any other desired typed of peripheral apparatus, such as a device for rethreading a prewinder, an apparatus for automatically replacing empty yarn packages, etc.

In its normal position, the rotatable assembly 27 is preferably positioned such that one of the yarn packages 4 and the corresponding thread preparation devices 5 are located precisely at the point of the peripheral apparatus, in this case the repair unit 18.

Figure 8:
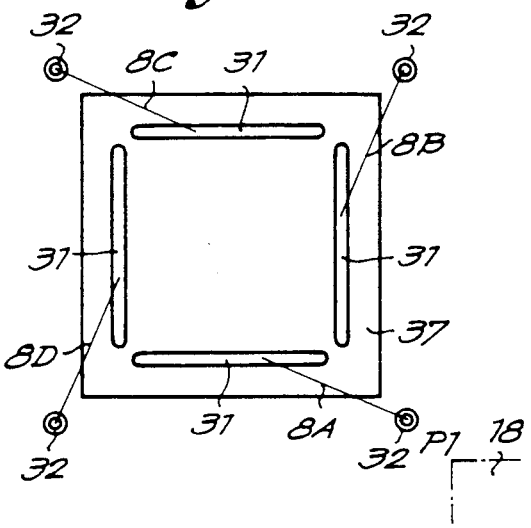
FIGS. 8 to 11 show a cross-section along line VIII—VIII in FIG. 6, for various positions.

In FIG. 8, the supply of weft thread 8A is provided by the yarn package 4 and the thread preparation device 5. The fact that the assembly 27 is positioned such that one yarn package 4 and the corresponding thread preparation device 5 are located at the point of the peripheral apparatus 18 offers the advantage that no further rotation is needed whenever the peripheral apparatus 18 has to intervene in order to carry out an operation on the weft thread 8A. Only if something occurs to weft threads 8B, 8C or 8D does a rotation have to be carried out.

Figure 9:
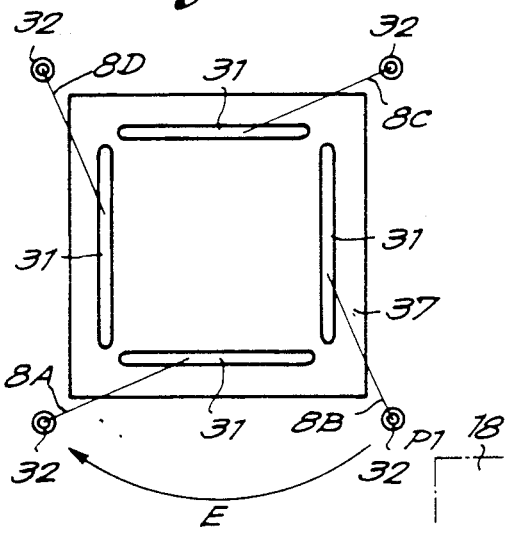

FIG. 9 shows the position when the supply of weft thread 8B has to be presented to the peripheral apparatus 18. In this case the rotatable assembly 27 must be rotated through 90 degrees in the direction of arrow E, as shown in FIG. 8. Here it should be noted that in FIG. 6 the device is shown during this rotation in the direction of arrow E.

Figure 10:
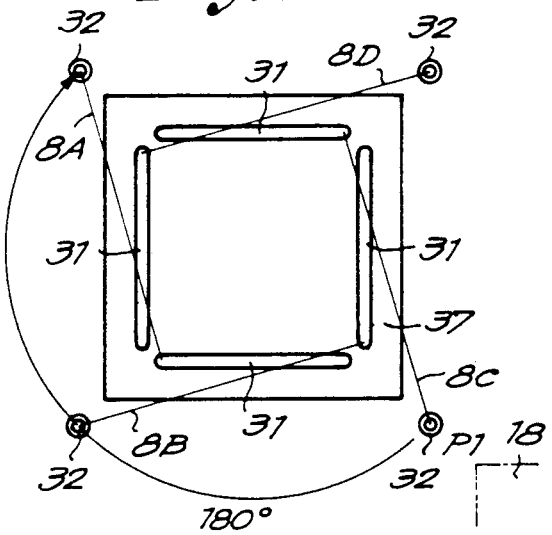
Figure 11:
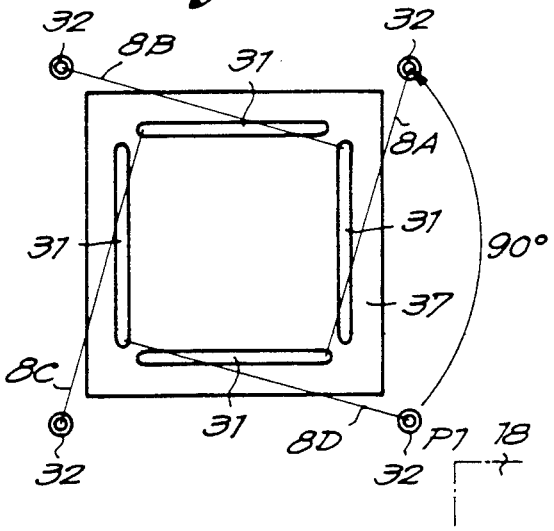
Figure 13:
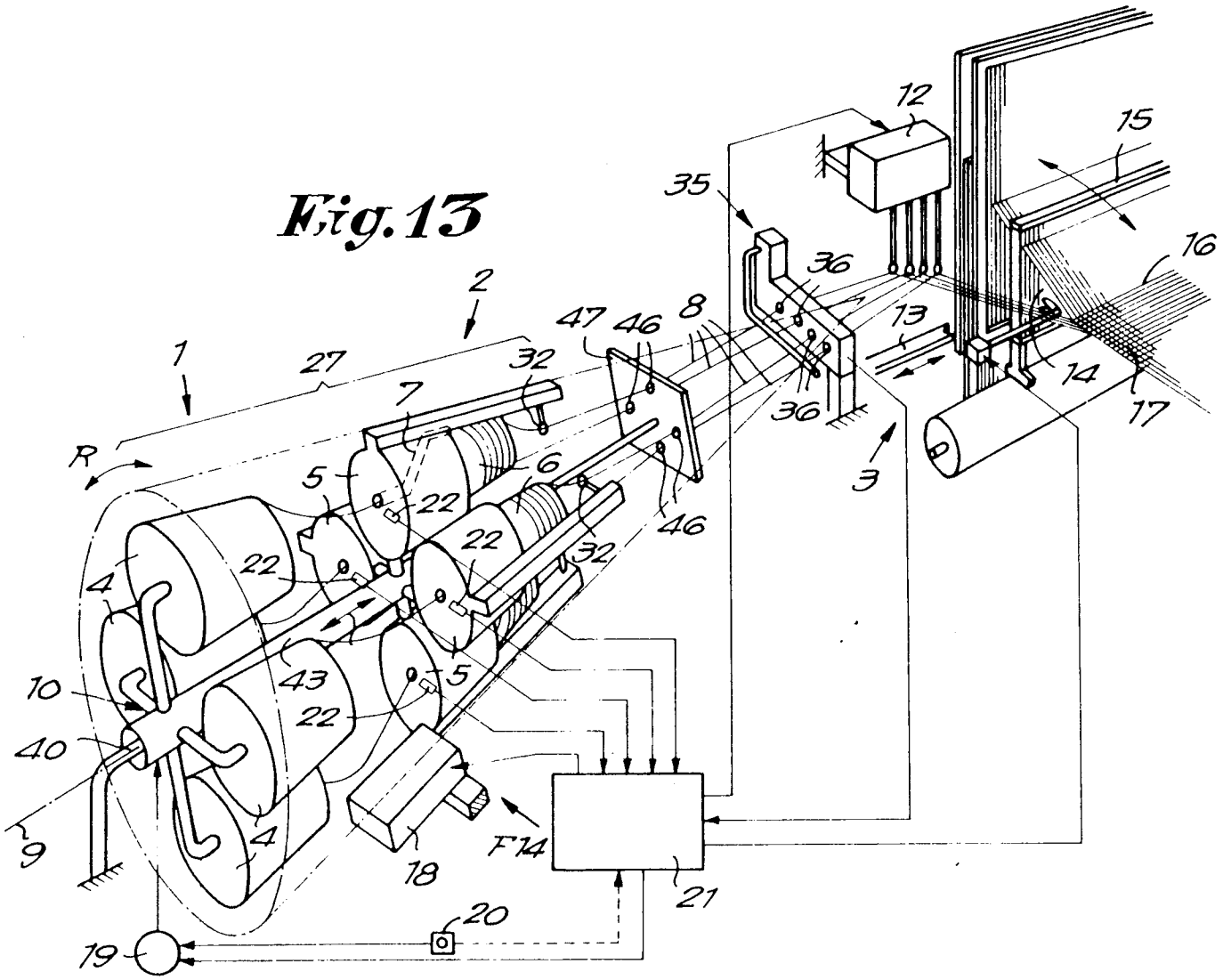
FIG. 13 shows schematically a particular embodiment of the device according to the invention.

FIGS. 10 and 11 show the positions in which the thread supply paths of the weft threads 8C and 8D respectively have to be presented to the peripheral apparatus 18.

From the drawings it is clear that lengthening of the threads as a result of the rotation of the assembly 27 is kept to a minimum by the displacement of the weft threads 8A to 8D in the thread guide slots 31.

As shown in FIG. 12, the thread guide slots 31 can also be curved, preferably in the form of arcs of circles, where the angles which they subtend overlap.

In order to achieve the best effect, the thread eyes 32 are preferably located centrally in front of the third thread guide device 30 and in a plane parallel to the plane in which the thread guide slots 31 are situated. Furthermore, the thread eyes 34 of the second thread guide device 29 are preferably situated opposite the centres of the thread guide slots 31.

Clearly, the second thread guide device 29 does not necessarily have to consist of the above-mentioned plate 33 and the thread eyes 34. In a simpler embodiment, the second thread guide device 29 can also be formed by the thread eyes 36 of the weft detector 35, as shown in FIG. 1.

However, it is recommendable for an arrangement as shown in FIG. 6 to be used, since the distribution of the weft threads 8A to 8D between the first and second thread guide devices 28 and 29 is then always symmetrical.

FIGS. 13 to 18 show embodiments in which, as indicated in the preamble, arrangements are made to compensate fully for the lengthening of the path followed by the weft threads 8 which normally occurs when the assembly 27 rotates, such that no sagging of the weft threads 8 occurs when the assembly 27 rotates back into its original position. The particular feature of this arrangement is that the device includes a means 39 which converts the rotation motion R of the assembly 27 into a translation motion T, essentially in the direction of the axis of rotation 9. For this purpose, the above-mentioned frame 10 is constructed so that it can not only rotate but also be displaced, for example along the shaft 40 extending in the direction of the axis of rotation 9.

Figure 14:
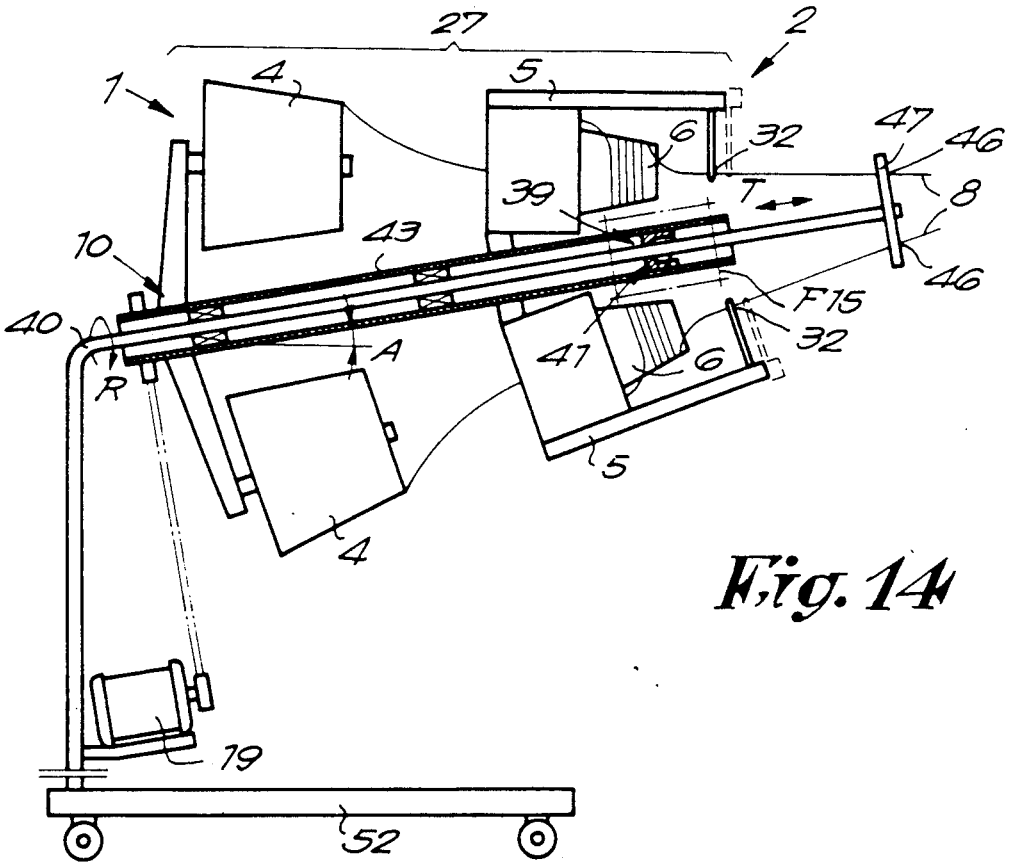
FIG. 14 is a side view in the direction of arrow F14 in FIG. 13.
Figure 15:
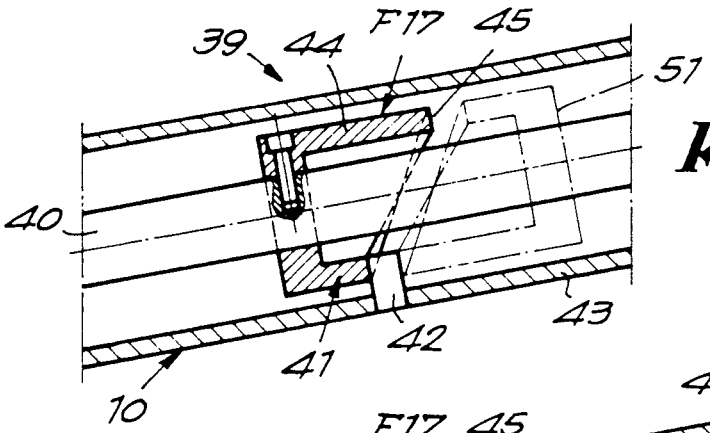
FIG. 15 shows the part indicated in FIG. 14 by F15, to a greater scale.

In the embodiment shown in FIGS. 14 and 15, the above-mentioned means 39 includes a cam follower mechanism having a cam 41 and a cam follower 42 which operates with the cam 41. One of these elements is mounted on the fixed shaft 40, while the other element is mounted on the rotatable frame 10.

In the embodiment shown in FIGS. 14 and 15, use is made of a frame 10 with a core in the form of a tube 43 which is mounted so that it can both rotate and slide on the shaft 40. The cam 41 consists of a cylindrical element 44 with a profiled head and 45. The cylindrical element 44 is mounted concentrically round the shaft 40, while the cam follower 42 consists of a pin which extends radially from the inside wall of the tube 43.

The rotatable assembly 27 is mounted at an angle A such that it slides downwards along the shaft 40 under its own weight, thereby ensuring permanent contact between the cam follower 42 and the cam 41.

In this arrangement the weft threads leave the rotatable assembly 27 via thread guides which rotate with it, such as the above-mentioned thread eyes 32, and then pass along fixed-mounted thread guides which in the non-rotated position of the assembly 27 are preferably situated opposite the thread eyes 32 and which for example include thread eyes 46 in a small plate 47 which is preferably mounted perpendicularly on the above-mentioned shaft 40.

It is clear from FIGS. 14 and 15 that as a result of the rotation of the assembly 27, for example by means of a motor 19 and the accompanying transmission, the cam 41 will follow the profiled shape of the head end 45, so that the assembly 27 will carry out a displacement. The profile of the cam 41 is chosen such that when the assembly 27 rotates a displacement occurs such that the distances between the thread eyes 32 which rotate with the assembly 27 and the respective fixed-mounted thread eyes 46 remain unaltered in length; in other words, the translation motion provides length compensation.

Figure 16:
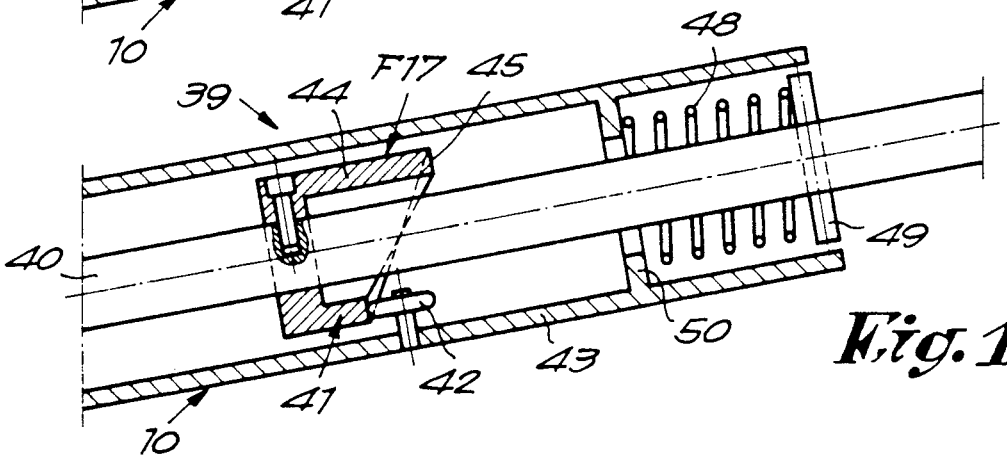
FIG. 16 is a side view similar to that of FIGS. 14 and 15 showing a variant of the part represented in FIG. 15.

As shown in FIG. 16, the cam follower 42 can for example also consist of a small wheel.

In order to ensure permanent contact between the cam follower 42 and the cam 41, an elastic device can be used, such as a pressure spring 48, mounted between a support 49 on the shaft 40 and a collar 50 in the tube 43. This embodiment offers the advantage that the assembly 27 need not be oriented slanting upwards. In a variant in which the slanting arrangement is not necessary, the means 39 consists of a cam follower mechanism which uses a slot cam. Such a slot cam can for example be obtained by mounting a second element 51 on the shaft 40 in the embodiment in FIG. 15, as shown by the dot-dash line.

FIG. 17 illustrates the form of cam 41, including cylindrical element 44 and profiled head and 45, as described above.

The embodiment just described with the cam follower mechanism has the advantage that the latter does not cause any obstacle, either to the weft threads or to the accessibility of other parts of the machine.

Preferably, the rotatable assembly 27 is mounted on a separate movable frame 52, which can be placed next to the weaving machine. In such an embodiment, the preference is for the thread guides formed by the thread eyes 46 also to be mounted on the frame 52, for example as already described on the front end of the fixed shaft 40. However, it is clear that the rotatable assembly 27 can also form part of the weaving machine.

Figure 18:
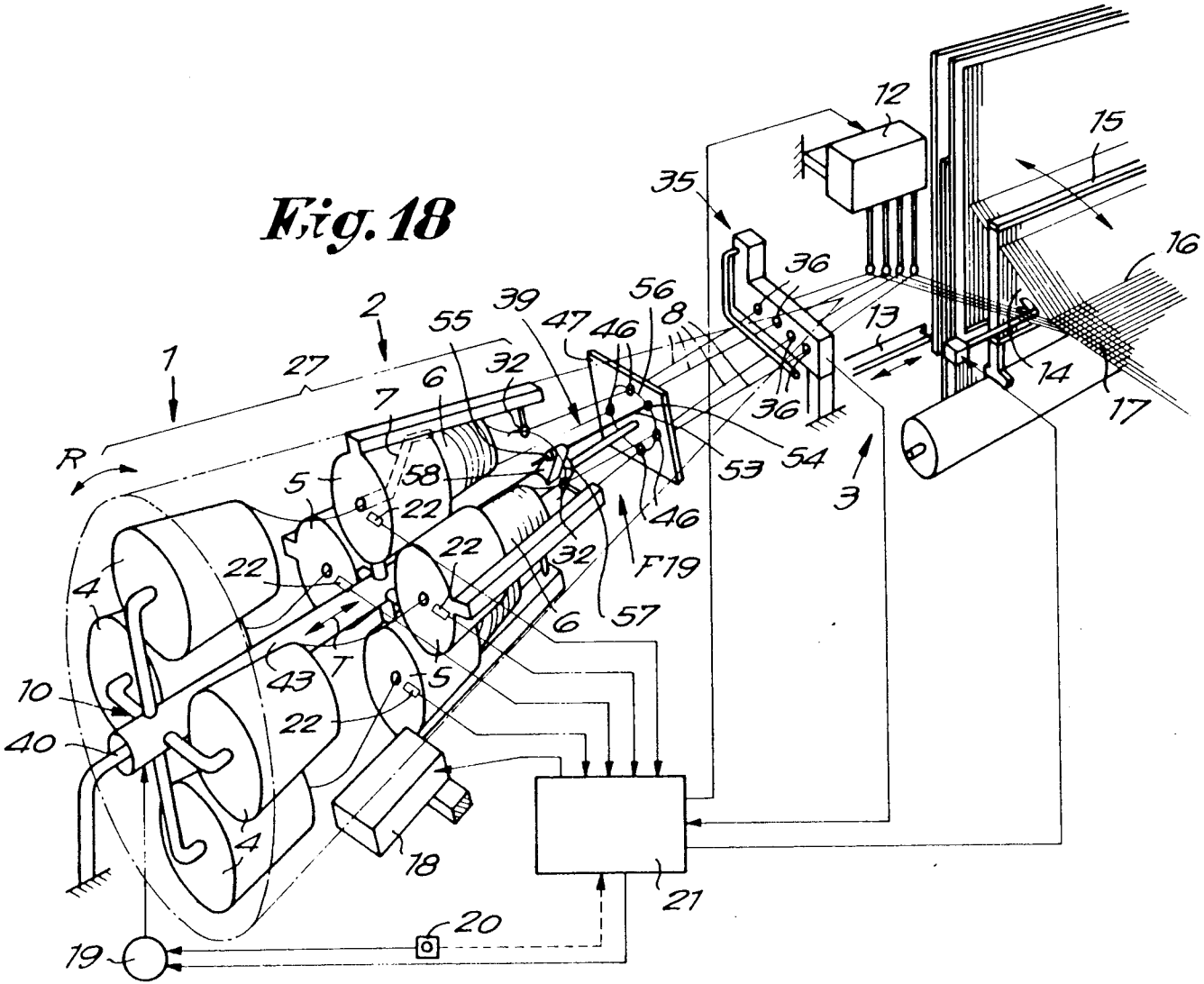
FIG. 18 is a perspective view of a variant of the device according to the invention.

In the embodiment shown in FIG. 18, the means 39 which converts the rotation motion R of the assembly 27 into a translation motion includes at least one link 53 extending in the direction or more or less in the direction of the shaft 40, between a fixed attachment point 54 and an attachment point 55 mounted on the rotating frame 10. The link 53 is folding and/or hinge mounted at the attachment points 54 and 55.

As shown in FIG. 18 the above-mentioned thread guides or eyes 46 and the fixed attachment point 54 are preferably situated on the same descriptive circle 56, for example with the link 53 attached to the plate 47. The thread guides or eyes 32 and the above-mentioned attachment point 55 which rotate with the assembly 27 are also situated on the same circle 57, for example with the link 53 attached to a support 58 mounted radially on the frame 10. The attachment points 54 and 55 are located opposite each other in a similar manner to the complementary thread eyes 32 and 46. Since the link 53 is situated in the same circles 56 and 57 as the thread eyes and lies at exactly the same angle as the weft threads 8, the length of this link is equal to the length of thread between the thread eyes 32 and 46. This has the advantage that precise compensation is obtained when the rotating assembly 27 rotates.

Figure 19:
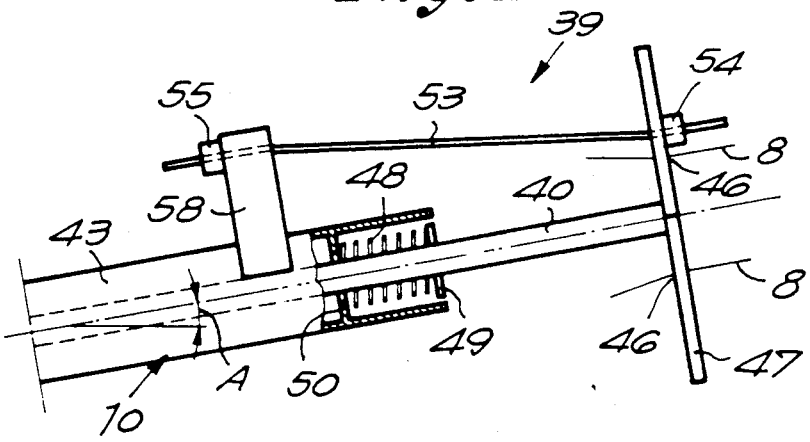
FIG. 19 is a side view in the direction of arrow F19 in FIG. 18, to a greater scale.

FIG. 19 shows an embodiment in which the link 53 consists of a cable or flexible tie. In this case the necessary arrangements must be made to ensure that the link 53 remains taut when the assembly 27 rotates back to its original position. This can be done, in a similar way to the first embodiment mentioned, by mounting the assembly 27 at an angle so that its weight keeps the link 53 taut. In a variant, this can also be achieved by means of an elastic device, such as a pressure spring 48, in a similar way as in the embodiment shown in FIG. 16.

Figure 20:
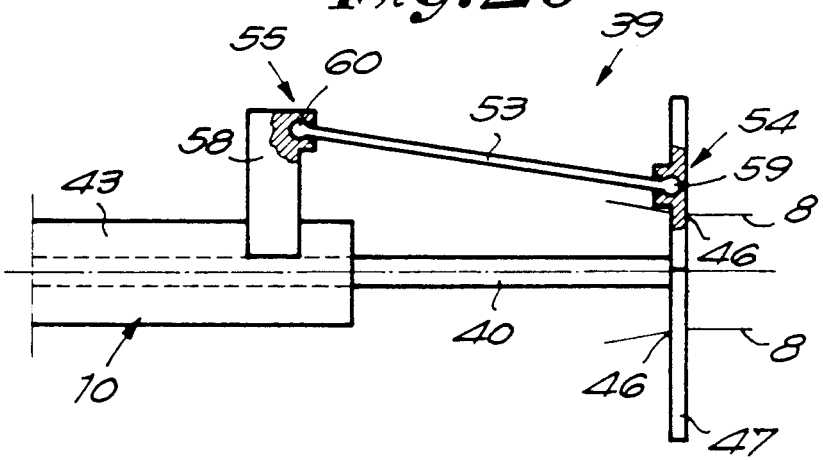
FIG. 20 is a side view of a variant of the part shown in FIG. 19.

In FIG. 20 the link 53 consists of a bar hinge-mounted at each end at the attachment points 54 and 55 by means of ball-and-socket joints 59 and 60. A separate return device such as an elastic device 48 or suchlike is not then required.

Clearly, instead of one single link 53 there can be several links 53 mounted in a similar way, for example between all the corresponding thread eyes 32 and 46.

The present invention is not limited to the embodiments described by way of example and shown in the figures; on the contrary, such a device for supplying weft threads on weaving machines can be made in different forms and dimensions while still remaining within the scope of the invention.

We claim:

1. A device for supplying weft threads to a weaving machine shed, comprising a plurality of thread supplies and means for operatively connecting said thread supplies for rotation together as a set; a set of thread preparation mechanisms including means for receiving weft threads from said thread supplies; means for operatively connecting said thread preparation mechanisms and thread supplies such that said thread preparation mechanisms are rotatable together with said set of thread supplies; and insertion means for inserting weft threads received from the thread preparation mechanisms into the shed of the weaving machine, wherein said set of thread supplies and corresponding set of thread preparation mechanisms have a common axis of rotation, and said device further comprises means for permitting said thread supplies and thread preparation mechanisms to be rotated at any moment to any angular position.

2. A device as claimed in claim 1 wherein each thread supply has a corresponding thread preparation mechanism which is located substantially in line with the corresponding thread supply.

3. A device as claimed in claim 2, wherein the thread supplies and the thread preparation mechanisms are arranged substantially in the form of a cone, with the apex of the cone oriented towards the insertion means, the thread supplies lying along the circumference of the base of the cone, and the thread preparation mechanisms lying substantially on the surface of the cone between the thread supplies and the insertion means.

4. A device as claimed in claim 1, wherein the thread supplies include yarn packages and the thread preparation mechanisms include prewinders having prewinder drums and winding tubes.

5. A device as claimed in claim 1 comprising two rotatable sets of thread supplies and two rotatable sets of thread preparation mechanisms, one of said sets of thread supplies and one of said sets of thread preparation mechanisms being arranged substantially in the form of a first cone, and the other of said sets of thread supplies and said sets of thread preparation mechanisms being arranged in the form of a second cone, wherein the respective generatrixes of the two cones which are located closest to each other are parallel to each other.

6. A device as claimed in claim 1, further comprising means including a thread guide located between said set of thread preparation mechanisms and the insertion means for permitting the set of thread supplies and the set of thread preparation mechanisms to rotate together through at least 180 degrees, without the respective weft threads becoming entangled.

7. A device as claimed in claim 1, wherein said means for permitting rotation further comprises a drive mechanism for rotating said set of thread supplies and said set of thread preparation mechanisms.

8. A device as claimed in claim 7, further comprising detector means for operating on the weft threads to detect faults and a control unit connected to said detector means, said control unit including means for controlling said drive means such that, if a fault is detected, the sets of thread supplies and thread preparation devices are rotated together until a thread supply and a thread preparation device in which the fault has been detected are rotated to a predetermined point.

9. A device as claimed in 8, further comprising repair means for repairing broken weft threads and for rethreading a thread preparation mechanism, wherein said repair means is mounted next to the rotatable sets of thread supplies and thread preparation mechanisms at said predetermined point.

10. A device as claimed in claim 8, further comprising means for automatically changing yarn packages, wherein said changing means is mounted next to the rotatable set of thread supplies and the rotatable set of thread preparation mechanisms at said predetermined point.

11. A device as claimed in claim 1, further comprising a thread guide including means including a first thread guide device formed by thread guide points arranged in a ring for guiding threads from said first thread preparation mechanism, said first thread guide device including means for rotating said first thread guide device with said thread supplies and thread preparation mechanisms; a second, fixedly-mounted thread guide device including means for leading the weft threads towards the insertion means; and a third, fixedly-mounted thread guide device located between said first and second thread guide devices, said third thread guide device comprising means including a plurality of thread guide slots arranged in a ring for guiding respective weft threads.

12. A device as claimed in claim 11, wherein said thread guide slots include four linear slots arranged around the four sides of a square.

13. A device as claimed in claim 11, wherein said thread guide slots are curved so as to substantially form arcs of circles.

14. A device as claimed in claim 11, wherein the angles subtended by the thread guide slots are overlapping.

15. A device as claimed in claim 11, wherein the thread guide slots are formed by openings in a fixedly-mounted plate.

16. A device as claimed in claim 11, wherein said second guide thread device includes thread eyes formed in a plate.

17. A device as claimed in claim 16, wherein the positions of the thread eyes of said second thread guide device correspond to positions of the centers of said thread guide slots.

18. A device as claimed in claim 11, wherein said second thread guide device includes thread eyes of a weft detector.

19. A device as claimed in claim 11, wherein said set of thread supplies and thread preparation mechanisms together form a rotatable assembly, and further comprising means for converting a rotational motion of said rotatable assembly into a translational motion in the direction of the axis of rotation around which the rotatable assembly rotates.

20. A device as claimed in claim 11, wherein said first thread guide device comprises means including thread eyes for guiding the weft threads at outputs of the thread preparation mechanisms.

21. A device as claimed in claim 19, further comprising means for leading the weft threads from said thread preparation mechanisms via said first thread guide device to said second and third thread guide devices, and wherein said means for converting the rotational motion into a translational motion include means for carrying out a displacement of said rotatable assembly in the direction of said axis of rotation such that during a rotation motion, the distances between the co-rotating first thread guide device and the respectively fixedly-mounted thread guides remain substantially unchanged.

22. A device as claimed in claim 19, wherein said means for converting the rotational motion of the rotatable assembly into a translational motion comprises a cam follower mechanism.

23. A device as claimed in claim 22, wherein said cam is a slot cam.

24. A device as claimed in claim 22, wherein said rotatable assembly is mounted at a non-zero angle in respect to horizontal such that the cam follower and the cam remain in contact with each other under the weight of said assembly.

25. A device as claimed in claim 22, wherein said rotatable assembly comprises a rotatable frame and means for rotating said frame on a fixed shaft, and said cam follower mechanism comprises a cam integrally attached to said shaft, and a cam follower attached to said rotatable frame.

26. A device as claimed in claim 25, wherein the cam comprises a cylindrical element having a profiled head end, said element being fitted over said shaft.

27. A device as claimed in claim 22, wherein said rotatable frame includes a core comprising a tube and means for rotating said tube about said shaft and the cam attached thereto, and wherein the cam follower is attached to the inside of said tube.

28. A device as claimed in claim 22, further comprising means including an elastic device for insuring contact between the cam and the cam follower.

29. A device as claimed in claim 19, wherein said rotatable assembly includes means for permitting said rotatable assembly to rotate about a fixed shaft, and further comprising means including fixed thread guides mounted on said shaft for leading respective weft threads away from said rotatable assembly.

30. A device as claimed in claim 19, wherein said means for converting a rotational motion of the rotatable assembly into a translational motion comprises at least one flexible hanging link attached at its ends between a fixed attachment point and another attachment point, and further comprises means for rotating said another attachment point with the rotatable assembly.

31. A device as claimed in claim 30, wherein said link is a cable-type element.

32. A device as claimed in claim 31, wherein said rotatable assembly is mounted at a non-zero angle in respect to horizontal such that the link is kept permanently tensioned under the weight of said assembly.

33. A device as claimed in claim 31, further comprising an elastic device which keeps said link taut.

34. A device as claimed in claim 30, wherein said link is a barb.

35. A device as claimed in claim 30, wherein said thread guide points and the attachment point to the rotatable assembly are located on a first circle, and wherein said thread guide slots and the second attachment point are located on a second circle, said attachment points being located at corresponding positions on the respective circles.

* * * * *